US007757685B2

(12) United States Patent
Kim et al.

(10) Patent No.: US 7,757,685 B2
(45) Date of Patent: Jul. 20, 2010

(54) RADIATION BURNER

(75) Inventors: Young Soo Kim, Changwon-si (KR); Dae Hee Jung, Changwon-si (KR); Dae Rae Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 890 days.

(21) Appl. No.: 11/135,649

(22) Filed: May 24, 2005

(65) Prior Publication Data

US 2006/0040228 A1 Feb. 23, 2006

(30) Foreign Application Priority Data

Nov. 27, 2003 (KR) ..... 10-2003-0085002
Nov. 27, 2003 (KR) ..... 10-2003-0085003

(51) Int. Cl.
*F24C 3/00* (2006.01)
*F24C 3/04* (2006.01)
*F24C 3/08* (2006.01)

(52) U.S. Cl. ..... 126/39 K; 126/39 H; 126/39 N; 126/39 J; 126/214 R; 126/214 D

(58) Field of Classification Search ..... 126/39 H, 126/39 J, 39 N, 39 K, 211, 214 R, 214 A, 126/214 D
See application file for complete search history.

(56) References Cited

U.S. PATENT DOCUMENTS 1,338,870 A * 5/1920 Schall ..... 126/39 J
1,582,634 A * 4/1926 Caldwell ..... 126/214 R
1,735,654 A * 11/1929 O'Dowd ..... 126/39 J
2,169,660 A * 8/1939 O'Dowd ..... 126/39 H
2,358,527 A * 9/1944 Moecker Jr., et al. ..... 126/39 H
2,870,829 A * 1/1959 Williams ..... 126/39 H
3,198,240 A * 8/1965 Keith et al. ..... 431/329
3,229,680 A * 1/1966 Hebert et al. ..... 126/92 B
3,241,542 A * 3/1966 Lotter ..... 126/39 J
3,310,098 A * 3/1967 Hardison ..... 431/329
3,437,085 A * 4/1969 Perry ..... 126/21 A
3,468,298 A * 9/1969 Teague Jr., et al. ..... 126/39 J
3,470,862 A * 10/1969 Morse et al. ..... 126/39 J
3,494,350 A * 2/1970 Perl ..... 126/39 J (Continued)

FOREIGN PATENT DOCUMENTS

DE 3024445 2/1981
DE 3844081 7/1990
EP 125750 A2 * 11/1984
EP 0 601 270 A1 6/1994
EP 0 627 599 * 10/1994
EP 1 225 393 A3 7/2002
GB 2073868 A * 10/1981
GB 2087535 A * 5/1982
GB 2 213 254 A 8/1989
KR 2002056338 * 7/2002
KR 2002056456 * 7/2002
KR 10-2003-73117 9/2003
KR 10-2004-50746 6/2004

OTHER PUBLICATIONS

German Office Action Dated Apr. 28, 2006.
Search Report issued by the United Kingdom Patent Office on Sep. 20, 2005.
Australian Office Action dated Sep. 6, 2006.

*Primary Examiner*—Carl D Price
(74) *Attorney, Agent, or Firm*—KED & Associates, LLP

(57) ABSTRACT

The present invention provides a radiation burner, by which thermal efficiency is enhanced. The present invention includes a pot configured to burn gas, a mat provided to on the port, the mat heated by combustion of the gas to radiate thermal energy, a housing provided on the mat, the housing configured to allow radiation energy of the mat to pass through, a support member provided on the housing to support an object, and a barrier provided within the housing to suppress an exhaust of the burnt gas.

18 Claims, 5 Drawing Sheets

U.S. PATENT DOCUMENTS

| | | | | | |
|---|---|---|---|---|---|
| 3,525,325 | A | * | 8/1970 | Perl | 126/39 J |
| 3,628,902 | A | * | 12/1971 | Huebler et al. | 431/2 |
| 3,633,562 | A | * | 1/1972 | Morse et al. | 126/39 J |
| 3,799,142 | A | * | 3/1974 | Jensen | 126/39 J |
| 3,804,578 | A | * | 4/1974 | Robbins | 431/158 |
| 3,852,025 | A | * | 12/1974 | Placek | 431/329 |
| 3,968,785 | A | * | 7/1976 | Perl | 126/39 J |
| 4,039,275 | A | * | 8/1977 | McGettrick | 431/329 |
| 4,201,184 | A | * | 5/1980 | Scheidler et al. | 126/39 J |
| 4,285,666 | A | * | 8/1981 | Burton et al. | 431/347 |
| 4,639,213 | A | | 1/1987 | Simpson | 431/326 |
| 4,850,335 | A | * | 7/1989 | Farnsworth et al. | 126/299 R |
| 4,951,646 | A | * | 8/1990 | Diekmann et al. | 126/39 J |
| 5,139,007 | A | * | 8/1992 | Bertomeu Martinez | 126/39 J |
| 5,326,257 | A | * | 7/1994 | Taylor et al. | 431/329 |
| 5,509,403 | A | * | 4/1996 | Kahlke et al. | 126/39 E |
| 5,645,043 | A | * | 7/1997 | Long et al. | 126/92 AC |
| 5,816,235 | A | * | 10/1998 | Kim et al. | 126/39 H |
| 6,349,714 | B1 | * | 2/2002 | Hurley et al. | 126/39 J |
| 2002/0088453 | A1 | | 7/2002 | Yamada et al. | 126/39 |

FOREIGN PATENT DOCUMENTS

* cited by examiner

RADIATION BURNER

BACKGROUND OF TH INVENTION

1. Field of the Invention

The present invention relates to a radiation burner, and more particularly, to a mechanism for enhancing thermal efficiency of a radiation burner.

2. Discussion of the Related Art

Generally, a radiation burner heats an object in a manner of heating a radiation body by combustion of a mixed gas of fuel and air and using thermal energy radiating from the radiation body.

Such a radiation burner consists of a pot, a radiation body installed over the pot, and a housing provided over the radiation body. And, a support member is provided to the housing to support an object to be heated. The mixed gas burns in the pot to heat the object. The heated object radiates thermal energy so that the radiated energy heats the object on the support member.

However, in the general radiation burner, the burnt gas at considerably high temperature is directly discharged outside via the housing. And, the hot combustion gas heats the housing so that the heated housing dissipates heat to raise a room temperature. For theses reasons, the general radiation burner has a considerably high heat loss to lower thermal efficiency thereof.

SUMMARY OF THE INVENTION

Accordingly, the present invention is directed to a radiation burner that substantially obviates one or more problems due to limitations and disadvantages of the related art.

An object of the present invention is to provide a radiation burner, by which thermal efficiency is enhanced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a radiation burner according to the present invention includes a pot configured to burn gas, a mat provided to on the port, the mat heated by combustion of the gas to radiate thermal energy, a housing provided on the mat, the housing configured to allow radiation energy of the mat to pass through, a support member provided on the housing to support an object, and a barrier provided within the housing to suppress an exhaust of the burnt gas.

Preferably, the barrier is configured to block a flow of the burnt gas to be exhausted.

Preferably, the barrier upwardly extends from a bottom of the housing.

Preferably, a width of the barrier is equal to or smaller than a width of the housing.

Preferably, a height of the barrier is smaller than a height of the housing.

Preferably, the barrier has a predetermined curvature.

Preferably, the barrier is configured to enclose the mat.

Preferably, the housing is provided with an opening to allow radiation heat of the mat to pass through and the barrier is configured to enclose the opening.

Preferably, the barrier has a dual structure.

Preferably, a portion of the barrier is configured to allow the burnt gas to pass through.

Preferably, the barrier includes a first barrier situated in the vicinity of the mat and a second barrier separated from the first barrier to leave a predetermined interval in-between.

More preferably, a height of the first barrier is smaller than a height of the second barrier.

More preferably, the second barrier includes a multitude of perforations.

Preferably, the barrier is configured to be heated by the burnt gas to radiate energy.

Preferably, the barrier is configured to guide the radiation energy of the mat to the object to be heated.

Preferably, the radiation burner further includes a gasket inserted between the mat and the housing.

More preferably, the gasket is configured to prevent a flame of the burnt gas to reach the housing.

More preferably, the gasket is provided with an opening communicating with the opening of the housing.

More preferably, the opening of the gasket has a diameter smaller than that of the opening of the housing.

More preferably, the gasket is configured to adjust a radiation area of the mat.

More preferably, the gasket is configured to vary a diameter of the opening of the gasket.

Preferably, the radiation burner further includes an isolation member provided to the housing.

More preferably, the isolation member covers an outer surface of the housing.

Therefore, the heat loss of the radiation burner is considerably reduced to raise thermal efficiency.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
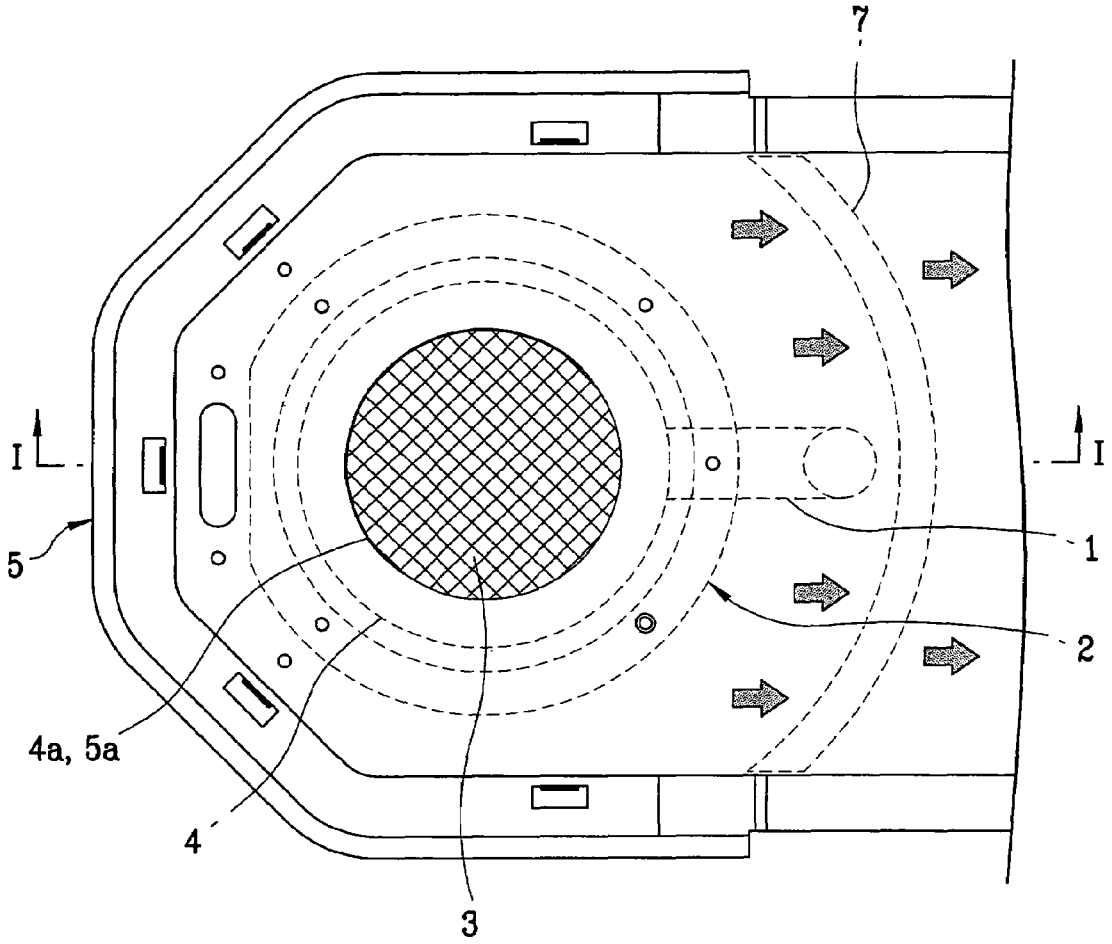
FIG. 1 is a schematic layout of a radiation burner according to the present invention.

FIG. 1 is a schematic layout of a radiation burner according to the present invention.

Referring to FIG. 1, a radiation burner according to the present invention basically includes a pot 2, a mat 3 provided on the pot 2, a housing 5 provided on the mat 3, and a support member 6 provided on the housing 5. Optionally, a gasket 4 can be inserted between the mat 3 and the housing 5.

The pot 2 is connected to a mixing pipe 1. The mixing pipe 1 mixes fuel and air together to form a mixture gas. The mixture gas is supplied to the pot 2 to be burned within the pot 2. And, the pot 2 is assembled to the housing 5.

The mat 3 includes a body enabling radiation of thermal energy, i.e., a radiation body to be placed on a seat 2*a* provided to an upper part of the pot 2. Specifically, the mat 3 is red-heated by the flame generated from the combustion of the gas to radiate the combustion energy as thermal energy. The gasket 4 prevents the burnt gas from leaking between the pot 2 and the housing 5. And, the gasket 4 has an opening 4*a* of a predetermined size to allow the radiated energy to pass through.

The housing 5 has an opening 5*a* to allow the radiation energy of the mat 3 to pass through. The opening 5*a* of the housing 5 communicates with the former opening 4*a* of the gasket 4. An inner space of the housing 5 plays a role as a sort of a passage. Hence, the burnt gas is exhausted from the burned along the inner space of the housing 5 in a direction indicated by arrows in the drawings.

The support member 6 plays a role in supporting an object to be heated. The support member 6 is preferably formed of glass to facilitate transmission of the radiated energy.

Figure 2:
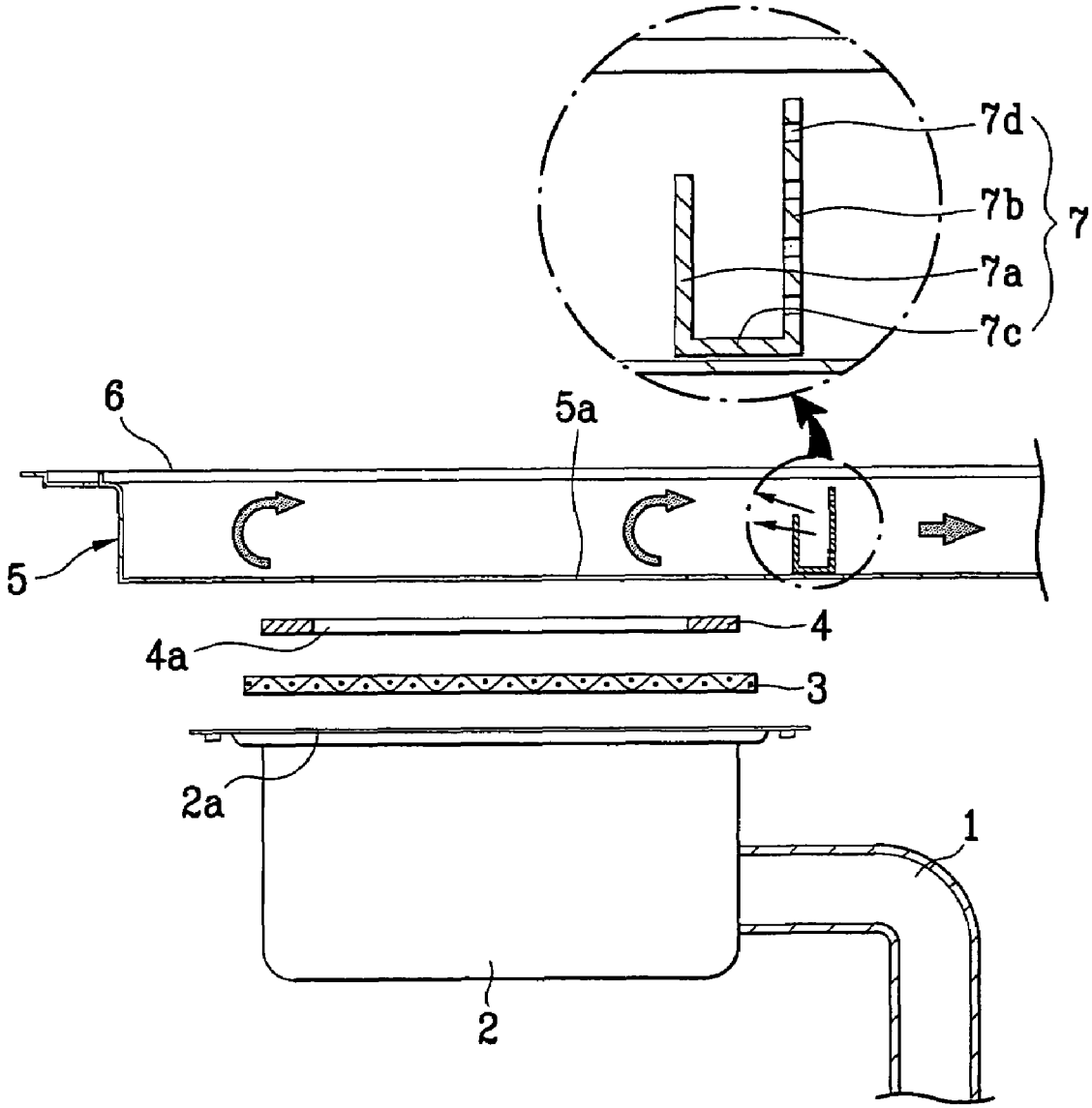
FIG. 2 is a cross-sectional diagram along a cutting line I-I in FIG. 1.

In the above-configured radiation burner, a barrier 7 is provided within the housing 5 to block a flow of the exhausted combustion gas. The barrier 7, as shown in FIG. 2, upwardly extends from a bottom of the housing 5. And, the barrier 7 extends over a width of the housing 5 to entirely block the flow of the burnt gas. Moreover, the barrier 7 extends to leave a predetermined gap from a lower surface of the support member 6 to enable the burnt gas to be exhausted to some extent. Namely, a width of the barrier 7 is set equal to or smaller than that of the housing 5 and an overall height of the barrier 7 is set smaller than a height of the housing 5. The barrier 7 preferably has a predetermined curvature. Specifically, in order to block the flow of the burnt gas more efficiently, the curved barrier 7 is configured to enclose the mat 3, and more accurately, the opening 5*a* of the housing 5 operative as the passage of the burnt gas. For the same reason, the barrier 7 has a dual structure.

Figure 3:
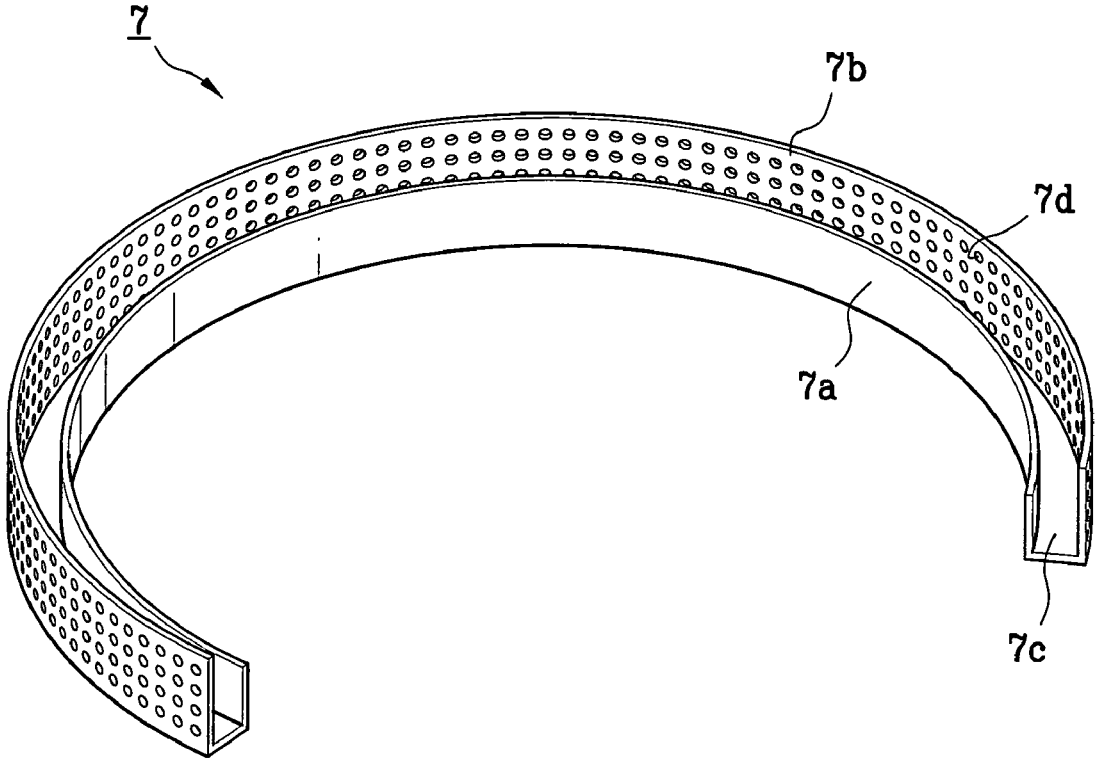
FIG. 3 is a perspective diagram of a barrier provided to the radiation burner in FIG. 1.

Specifically, the dual-structured barrier 7, as well shown in FIG. 2 and FIG. 3, includes a first barrier 7*a* situated in the vicinity of the opening 5*a* and a second barrier 7*b* separated from the first barrier 7*a* to leave a predetermined interval in-between. The first and second barriers 7*a* and 7*b* are joined together by a joining portion 7*c*. Despite blocking the flow of the burnt gas, the barrier 7 needs to allow the burnt gas to smoothly flow over the barrier 7 for the appropriate exhaustion. Hence, a height of the first barrier 7*a* is smaller than that of the second barrier 7*a*. Likewise, the second barrier 7*b* includes a multitude of perforations 7*d* to lower flow resistance for the appropriate exhaustion. Namely, the barrier 7 is configured to allow the brunt gas to pass through in part due to the perforations 7*d*.

As explained in the foregoing description, the barrier 7 blocks the flow of the burnt gas to suppress the burnt gas not to be directly discharged outside the burner. Namely, the barrier 7 enables the burnt gas to remain within the housing 5 for a predetermined duration. Hence, the burnt gas additionally transfers heat to the object to be heated. And, the barrier 7 absorbs heat from the burnt gas to additionally radiate thermal energy toward the object to be heated as indicated by arrows in FIG. 2. Consequently, the barrier 7 enables energy recovery and use of the burnt gas. Alternatively, the barrier 7 plays a role in guiding the radiation energy of the mat 3 to the object to be heated and is operative in defining a heating area of the object as well.

For theses reasons, the barrier 7 basically raises thermal efficiency of the burner of the present invention considerably. And, the raised thermal efficiency lowers heat discharge via the housing 3 and the support member 6, thereby suppressing an increment of a room temperature. Moreover, the radiation energy of the barrier 7 lowers a quantity of carbon monoxide of the burnt gas.

Figure 5:
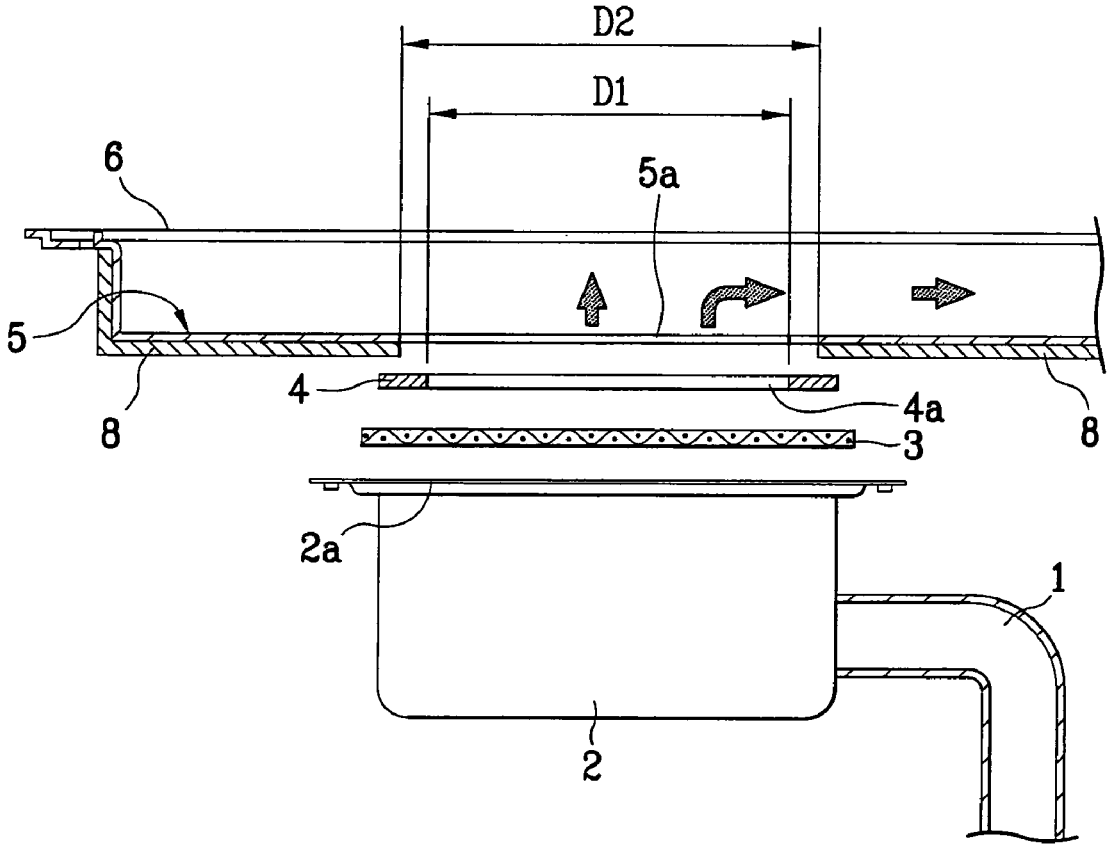
FIG. 5 is a cross-sectional diagram along a cutting line II-II in FIG. 4.

Preferably, an isolation member 8, as shown in FIG. 5, is provided to the housing 5. The isolation member 8 covers an outer surface of the housing 5. The isolation member 8 is preferably formed of a ceramic-based material. The radiation energy of the mat 3 and the heat of the burnt gas are not discharged into the air via the housing 3 by the isolation member 8 but can be used in heating the object on the support member 6 instead. Hence, the thermal efficiency of the burner is raised to suppress the increment of the room temperature.

Figure 4:
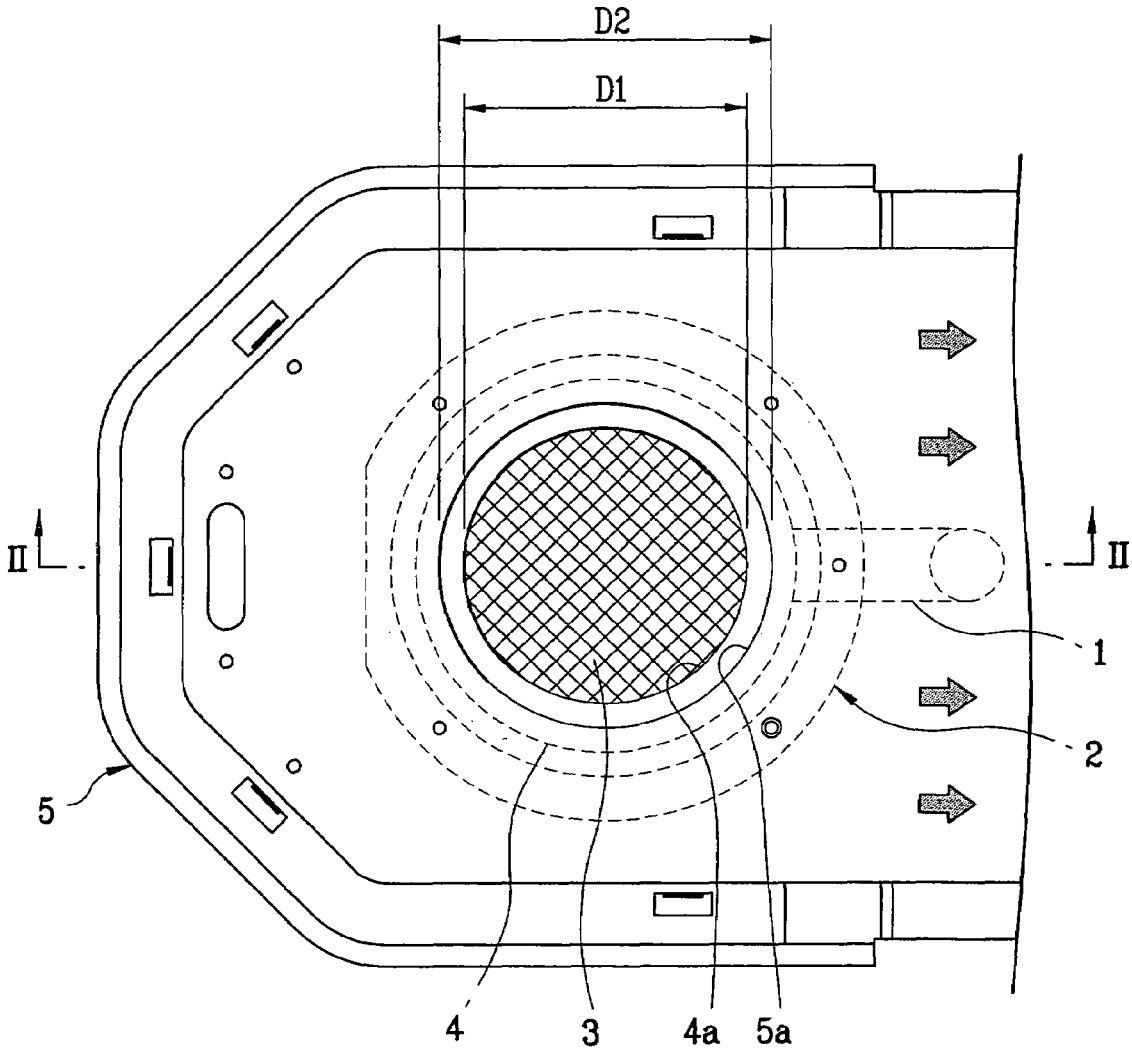
FIG. 4 is a schematic layout of a radiation burner according to another embodiment of the present invention.

Meanwhile, an edge of the opening 5*a* of the housing 5 becomes exposed to the flame within the pot 2, thereby being easily transformed. Such a transformation makes the burnt gas leak from the housing 5, whereby combustion failure occurs to increase the quantity of carbon monoxide in the exhausted burnt gas. To prevent such a phenomenon, a diameter D1 of the gasket opening 4*a*, as shown in FIG. 4, is formed smaller than that D2 of the housing opening 5*a*. Namely, an area of the housing opening 5*a* is formed greater than an area of the gasket opening 4*a* which substantially corresponds to an area of the rising flame. Hence, the flame avoids being directly brought into contact with the edge of the opening 5*a* of the housing 5, whereby the transformation of the housing 5 is prevented.

The former diameter D1 smaller than the latter diameter 2 can be found in a manner of inserting the gasket 4 having the former diameter D1 between the mat 3 and the housing 5. Alternatively, in one preferred embodiment of the present invention, the gasket 4 can be configured to vary its diameter D1 so that the diameter d1 of the gasket 4 is smaller than the latter diameter D2. Namely, the gasket 4 can include a mechanism for varying the former diameter D1. Such a variable diameter mechanism, of which detailed configuration is not shown in the drawing, can have the similar configuration of an iris diaphragm. In this case, a maximal diameter D1 of the gasket 4 should be smaller than the diameter D2 of the housing opening. Moreover, by varying the opening diameter D1, the gasket 4 can adjust the radiation area of the mat 3. For instance, by varying the diameter D1 of the gasket, the radiation area of the mat 3 can be optimized to be appropriate for a bottom area of the object on the support member 6. Hence, thermal efficiency can be enhanced.

As explained in the foregoing description, the gasket 4 is configured to prevent the flame from reaching the housing 5. by the gasket 4, the housing is prevented from being transformed to avoid the leakage of the burnt gas. Accordingly, the incomplete combustion of the gas is prevented to raise the thermal efficiency relatively and to lower the quantity of carbon monoxide.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A radiation burner, comprising:

a pot configured to burn gas;

a mat that extends across an open top portion of the pot, wherein the mat is heated by combustion of gas in the pot and radiates thermal energy;

a housing provided on the mat, wherein the housing is configured to allow thermal energy radiated by the mat to pass therethrough;

a support member provided on the housing, wherein the support member is configured to support an object thereon; and a barrier provided within the housing, surrounding an outer peripheral portion of the mat so as to concentrate thermal energy radiated by the mat and heat generated by the burnt gas within the housing, and to retard an exhaust of the burnt gas from the housing, the barrier comprising:

a first barrier portion positioned proximate to an outer peripheral edge of the mat; and a second barrier portion separated from the first barrier portion in a radial direction by a predetermined interval, wherein the second barrier portion includes a plurality of perforations that guide gas therethrough, wherein a gap between the support member and a top of the first barrier portion is greater than a gap between the support member and a top of the second barrier portion.

2. The radiation burner of claim 1, wherein the barrier extends upward from a bottom surface of the housing towards the support member.

3. The radiation burner of claim 1, wherein a height of the barrier is smaller than a height of the housing.

4. The radiation burner of claim 1, wherein the barrier has a predetermined curvature that is configured to surround the mat.

5. The radiation burner of claim 1, wherein the housing is provided with an opening to allow thermal energy radiated by the mat to pass therethrough, and wherein the barrier surrounds the opening in the housing.

6. The radiation burner of claim 1, the barrier further comprising:

a joining member extending between the first and second barrier portions.

7. The radiation burner of claim 6, wherein a height of the first barrier portion is less than a height of the second barrier portion.

8. The radiation burner of claim 1, wherein the barrier is configured to be heated by the thermal energy radiated by the mat so as to also radiate thermal energy.

9. The radiation burner of claim 5, further comprising a gasket inserted between the mat and the housing, wherein the gasket is configured to prevent a flame of the gas combusted in the pot from reaching the housing.

10. The radiation burner of claim 9, wherein the gasket is provided with an opening corresponding to the opening of the housing.

11. The radiation burner of claim 10, wherein the opening of the gasket has a diameter smaller than that of the opening of the housing.

12. The radiation burner of claim 9, wherein the gasket is configured to adjust a radiation area of the mat.

13. The radiation burner of claim 10, wherein the gasket is configured to vary a diameter of the opening of the gasket.

14. The radiation burner of claim 1, further comprising an isolation member that covers an outer surface portion of the housing.

15. The radiation burner of claim 14, wherein the isolation member is formed of a ceramic material.

16. The radiation burner of claim 1, wherein at least some of the plurality of perforations in the second barrier portion are positioned corresponding to the gap between the top of the first barrier portion and the support member.

17. The radiation burner of claim 1, wherein a shape of a peripheral edge of the first barrier portion corresponds to a shape of an outer peripheral edge of the mat.

18. The radiation burner of claim 17, wherein the second barrier portion is positioned radially outward from the first barrier portion, and wherein a shape of a peripheral edge of the second barrier portion corresponds to the shape of the peripheral edge of the first barrier portion such that the mat, the first barrier portion and the second barrier portion are substantially concentric.

* * * * *